United States Patent [19]

Eberlin

[11] 3,999,720

[45] Dec. 28, 1976

[54] SPINDLES FOR REELS AND OTHER SLEEVE-LIKE BODIES

[76] Inventor: Edgar Anthony Eberlin, Station Road, Bishops Cleeve, Cheltenham, England

[22] Filed: June 10, 1975

[21] Appl. No.: 585,483

[30] Foreign Application Priority Data

June 22, 1974 United Kingdom ..... 27805/74
Oct. 31, 1974 United Kingdom ..... 47249/74

[52] U.S. Cl. ..... 242/68; 242/72 R
[51] Int. Cl.[2] ..... B65H 17/02; B65H 75/18
[58] Field of Search ..... 242/68, 68.2, 72, 46.6; 279/1 R, 1 K, 1 ME, 1 T, 1 Q

[56] References Cited

UNITED STATES PATENTS

| | | | |
|---|---|---|---|
| 1,455,195 | 5/1923 | Foothorap | 242/68 |
| 2,561,745 | 7/1951 | Lerch | 242/72 |
| 2,582,010 | 1/1952 | Crosby | 242/72 |
| 3,606,187 | 9/1971 | Hahn | 242/68.2 |
| 3,689,003 | 9/1973 | Choinski | 242/68 |

*Primary Examiner*—Edward J. McCarthy
*Attorney, Agent, or Firm*—Andrus, Sceales, Starke & Sawall

[57] ABSTRACT

A spindle for receiving a reel or other sleeve-like body, for example for winding and unwinding paper rolls, is arranged so that reels can readily be mounted thereon and removed therefrom for rotation and drive transmission. Helical springs are disposed in longitudinally extending grooves in the cylindrical surface of the spindle. The bottoms of the grooves are so shaped that, if the springs are displaced from a central position in their respective grooves, the radial distance by which they project from the surface of the spindle increases. Thus, if such displacement is caused by frictional engagement with a reel or the like due to relative rotation of the spindle and the reels, the springs tend to grip the reel.

9 Claims, 4 Drawing Figures

SPINDLES FOR REELS AND OTHER SLEEVE-LIKE BODIES

This invention relates to spindles for reels and other sleeve-like bodies and has for an object to provide simple and improved means for detachably mounting a reel or other body for rotation and drive transmission. The invention is particularly applicable to the mounting of reels, cores and other sleeves for winding and unwinding paper rolls and other webs and sheeting including foil, film, plastics sheets and tapes, for which expanding chucks or mandrels have hitherto been used for the detachable coupling of the reel or other sleeve to a spindle.

According to the invention, there is provided a spindle for receiving a reel or other sleeve-like body comprising a cylindrical member having a longitudinally extending flexible cord recessed in its outer surface so as to project therefrom, the flexible cord being resistant to lateral compression and arranged in use to roll to lock the sleeve-like body to the spindle.

The cord is a length of helically wound spring steel. The recessing of the surface of the spindle may be provided by a longitudinal groove of greater width than the diameter of the cord, the cord lying normally centrally of the groove by so as to project radially outwardly beyond cylinder defining the spindle surface. When in use a sleeve is pushed over the spindle, the sleeve engages the cord in rolling contact. Any torque between the spindle and the sleeve causes the spring to roll laterally in the recess and in doing so to rise further above the circular cylinder defining the spindle surface into wedging engagement with the inside of the sleeve.

Preferably, two or more recesses, each containing a respective resilient cylinder are symmetrically disposed around the circumference of the spindle. The recesses preferably extend for substantially the whole of the effective length of the spindle.

The springs may be secured in position in their respective recesses by means of pegs secured in the ends of the springs and inserted into respective holes or slots in the spindle. Alternatively, the springs may have eyelets secured in their ends and fixed to the spindle by screws.

Two embodiments of the invention will now be described by way of example with reference to the accompanying drawings, in which.

Figure 1:
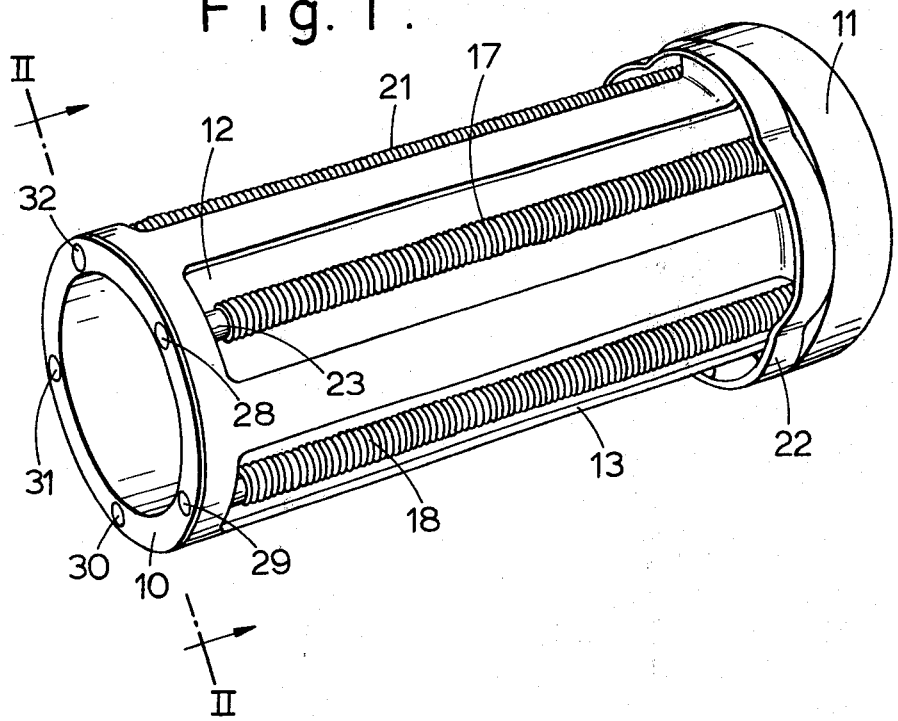
FIG. 1 is a perspective view of a spindle in accordance with the invention.
Figure 2:
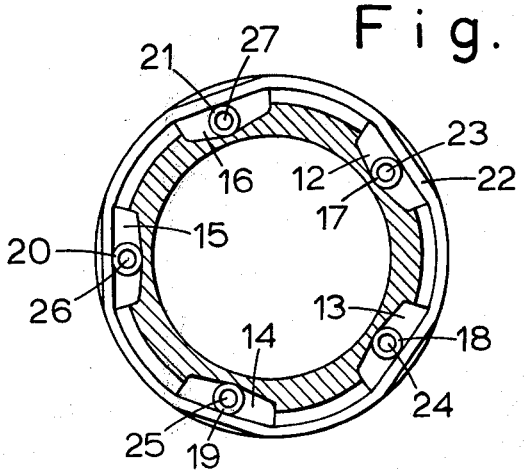
FIG. 2 is a cross-sectional view taken on the line II — II in FIG. 1.

Referring first to FIGS. 1 and 2, a thickwalled steel tube 10, typically 180 mm. in length, serves as a spindle for the winding of paper rolls upon cardboard sleeves or formers. An enlarged diameter portion 11, is provided at one end of the spindle whereby the latter may be mounted in a winding machine.

Cardboard sleeves of a size for use with the spindle 10 are a slack fit thereon and readily positioned thereon and withdrawn therefrom when required. For coupling the sleeves to the spindle 10 for drive transmission, the spindle 10 is formed with five longitudinally extending grooves 12 to 16 uniformly spaced around the circumference thereof. The grooves 12 to 16 have concave bottom surfaces. A respective length of tighly would helical wire spring 17 to 21, serving as a resilient cylindrical member is located in each of the grooves 12 to 16. The depth of the grooves 12 to 16 and the outside diameters of the springs 17 to 21 are chosen so that the side of each spring 17 to 21 projects radially outwardly beyond the cylinder defining the spindle surface. To retain the springs 17 to 21 in position, the end of each groove 12 to 16 adjacent to the enlarged diameter portion 11 of the spindle 10 is covered by a convoluted ring 22 having an inwardly directed convolution aligned with each groove, the curvature of each such convolution being substantially the same as that of the bottom surface of the corresponding groove thus providing a parallel sided slot for the reception of one end of the spring in such groove. A respective peg 23 to 27 is inserted into the other end of each spring 17 to 21 and engages in a corresponding hole 28 to 32 in the end wall of the groove at the other end of the spindle 10.

In use, relative rotation of the spindle 10 and a sleeve mounted thereon causes the springs 17 to 21, over that portion of their length engaged by the sleeve, to roll and move laterally towards one edge of their respective grooves 12 to 16, thus causing greater protuberance of each of the springs 17 to 21 from the cylinder defining the spindle surface so as to establish a wedging and locking engagement with the inside of the sleeve.

Alternatively, pegs may be provided at both ends of each spring, the width of the slots formed by the convoluted ring being such as to accommodate the pegs rather than the springs.

The springs 17 to 21 may be readily removed from the spindle 10 merely by bending the central region of the former so as to withdraw the corresponding end pins from their holes and slots. This facilitates replacement of defective springs.

The number of uniformly spaced grooves containing springs may be greater or less than five. Seven is a convenient number for large diameter spindles.

Figure 3:
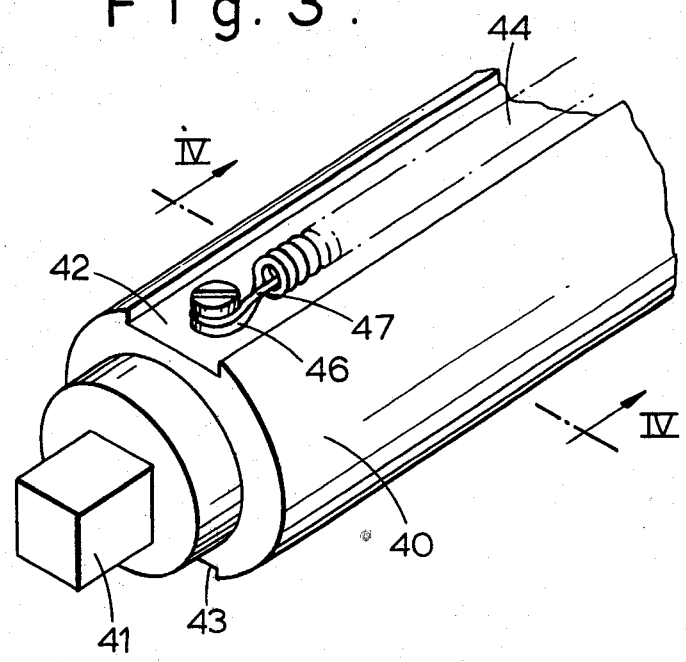
FIG. 3 is a perspective view of one end of another spindle in accordance with the invention.
Figure 4:
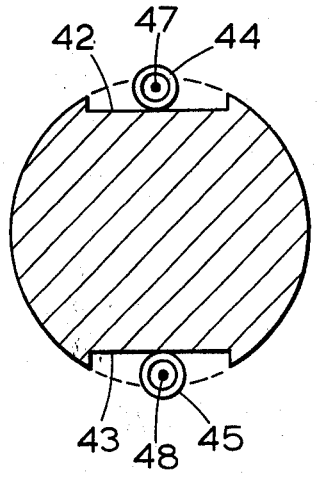
FIG. 4 is a cross-sectional view taken on the line IV — IV in FIG. 3.

FIGS. 3 and 4 show another spindle in accordance with the invention. A solid steel rod 40, typically of one meter in length, serves as a spindle for the winding of paper rolls upon cardboard sleeves or formers. The spindle 40 has a square end section 41 whereby it may be coupled to a winding machine. One or a plurality of sleeves may be threaded on to the spindle 40.

As with the embodiment illustrated in FIGS. 1 and 2, the sleeves are a slack fit on the spindle 40 and readily positioned therealong and withdrawn therefrom when required. For the coupling of the sleeves to the spindle for drive transmission, the spindle is formed with two full-length longitudinal diametrally-opposite grooves 42 and 43. The grooves 42 and 43 are rectangular in cross-section, the flat base lying centrally in a chord of the circle defining the spindle cross-section. A respective length of tightly wound helical wire spring 44 and 45 lies centrally in each groove 42 and 43 and extends through the length thereof under sufficient tension to remain straight, the springs 44 and 45 having end eyelets, such as the eyelet 46 in the spring 44, by which they are fastened to the spindle with the aid of short screws. The depth of the grooves 42 and 43 and the outside diameter of the springs 44 and 45 are chosen so that the sides of the springs 44 and 45 project radially outwardly beyond the cylinder defining the spindle surface, and, when in use a sleeve is pushed on to the spindle, engages the inside of the sleeve.

In use, relative rotation of the spindle 40 and a sleeve mounted thereon causes the springs 44 and 45, over that portion of its length engaged by the sleeve, to roll and move laterally towards one edge of their respective grooves 42 and 43, thus causing greater protuberence of each of the springs 44 and 45 from the cylinder defining the spindle surface so as to establish wedging and locking engagement with the inside of the sleeve.

For a core of 25 mm. diameter, helically wound spring wire of nominal diameter 3 mm., as commonly available, is suitable for use as the flexible cord, in which case the groove depth from the cylindrical surface of the spindle is desirably 2.5 mm. In general however the cord diameter and the number of grooves are chosen to suit the sleeve or reel size and the torque to be transmitted.

It will be noted that a sleeve is easily moved on to and along and off the spindle in the absence of a torque, also that non-uniformities in the inside diameter and surface of the sleeve are taken up by non-uniform rolling and displacement of the spring, accompanied by local flexure of the spring, to give line contact in wedging. Likewise, when a plurality of short sleeves are pushed end-to-end on to the spindle, each sleeve is individually engaged and locked on the spindle, this despite any departure from a nominal inside diameter and independently of position along the spindle. End cheeks or annular discs can also be positioned alongside or between the sleeves to prevent coning in unwinding or rewinding a roll. The tensioning of the spring ensures quick release of a sleeve from wedged engagement.

The number of grooves symmetrically spaced around the cylindrical surface may be more than two.

In order to limit the maximum stretching of the springs 44 and 45, they are each provided with a respective coaxial steel wire 47, 48 which is not normally under tension and of the same length as the spring in its maximum stretched condition.

In both embodiments of the invention, the spindle may be either tubular or of solid rod, a tubular spindle being preferred for larger diameters. The invention is applicable to a variety of spindle constructions, and bearing arrangements and may be used for example for takeoff rolls, coil winding, web, film, foil or tape feeds and re-reeling. The spindle or the grooved outer part thereof may be of aluminum or other metal or of a hard plastics material and the sleeve may be of metal, card or plastics material and may be in the form of a moulding. The sprindle diameter and length may be chosen from a wide range.

Spindles in accordance with the invention are of very simple construction, with few parts for wear and maintenance. In use, no action to engage or release the sleeve is required of the operator, such engagement and release resulting automatically from the application and cessation of a driving or pulling torque. Such a spindle considered as a mandrel is self-adapting to sleeve or reel irregularities of internal diameter, provides line wedging contact. The grooves in the spindle are shaped to provide an appropriate wedging angle in each direction and to that end, each groove has a base of cross-section which is flat, V-shaped or of curvature less than or opposite to the curvature of the spindle surface.

If it is desired to provide a longer core than can conveniently be made using springs extending for substantially the whole length thereof, a row of springs may be provided in each groove. For the embodiment shown in FIGS. 3 and 4, intermediate tapped holes are provided in each groove to receive the necessary additional fixing screws. For the embodiment shown in FIGS. 1 and 2, the groove is divided by intermediate lands to provide a respective sub-groove for each spring. A respective peg is secured to the adjacent land at each end of each sub-groove and is a loose fit in the end of the corresponding spring. The ends of the springs may be tapered to facilitate insertion.

What is claimed is:

1. A spindle for receiving a reel or other sleeve-like body comprising a cylindrical member having a longitudinally extending length of helically wound spring steel extending along substantially the whole of the operative length of the spindle and recessed in a groove in the outer surface of the reel so as to project therefrom, the groove being of greater width than the diameter of the cord and having a base which is so shaped that displacement of the cord laterally therein in either direction from its rest position increases the distance of radial projection of the cord from the surface of the spindle.

2. A spindle as claimed in claim 1, in which the base of the groove is concave.

3. A spindle as claimed in claim 1, in which the spring is secured against lateral displacement at one end, the other end having means engaging in a slot extending in a plane perpendicular to the longitudinal axis of the spindle.

4. A spindle as claimed in claim 3, in which the means for securing said one end of the spring against lateral displacement comprises a peg having one end inserted into the end of the spring and the other end engaging in a hole in an end wall of the groove.

5. A spindle as claimed in claim 3, in which the means engaging in a slot comprises the end of the spring.

6. A spindle as claimed in claim 1, in which both ends of the spring are secured against lateral displacement.

7. A spindle as claimed in claim 6, in which the spring is fixed at both ends so as to be under tension.

8. A spindle as claimed in claim 7, in which a steel wire extends coaxially within the spring and is secured at the two ends thereof to limit the maximum elongation of the spring.

9. A spindle as claimed in claim 1, having a plurality of flexible cords uniformly spaced around the periphery of the shaft.

* * * * *